US009543084B2

(12) United States Patent
Yamamoto et al.

(10) Patent No.: US 9,543,084 B2
(45) Date of Patent: Jan. 10, 2017

(54) SWITCH STATE DETECTION CIRCUIT AND SWITCH SYSTEM

(71) Applicant: Rohm Co., Ltd., Kyoto (JP)

(72) Inventors: Tomoki Yamamoto, Kyoto (JP); Hideki Matsubara, Kyoto (JP); Satoru Kominami, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 452 days.

(21) Appl. No.: 14/247,416

(22) Filed: Apr. 8, 2014

(65) Prior Publication Data

US 2014/0300208 A1 Oct. 9, 2014

(30) Foreign Application Priority Data

Apr. 9, 2013 (JP) ..... 2013-081192

(51) Int. Cl.
*H01H 9/16* (2006.01)

(52) U.S. Cl.
CPC ..... *H01H 9/167* (2013.01); *Y10T 307/747* (2015.04)

(58) Field of Classification Search
CPC ..... H01H 9/167; G06F 1/00; Y10T 307/747
USPC ..... 307/113
See application file for complete search history.

(56) References Cited

U.S. PATENT DOCUMENTS 5,637,933 A * 6/1997 Rawlings ..... H02J 13/0062 307/147
6,182,807 B1 * 2/2001 Saito ..... B60G 17/0185 191/2
7,940,673 B2 * 5/2011 Ballard ..... B60R 16/03 370/241
2006/0253718 A1 * 11/2006 Kawase ..... G06F 1/3203 713/300
2012/0078384 A1 * 3/2012 Kanayama ..... H01H 1/605 700/12

FOREIGN PATENT DOCUMENTS

JP 2011-070309 4/2011

* cited by examiner

*Primary Examiner* — Jeffrey Shin
(74) *Attorney, Agent, or Firm* — Fish & Richardson P.C.

(57) ABSTRACT

A switch state detection circuit according to the present invention comprises: a plurality of switch connection portions to each of which a switch is connected, a connection line to which any one of the switch connection portions is connected in a switchable manner, a detection portion that detects a state of the switch connected to the connection line based on a state of the connection line, and a connection control portion that switches successively each of the switch connection portions and connects it to the connection line, wherein the state of each switch is detected.

13 Claims, 11 Drawing Sheets

FIG.4

| OPEN-CLOSED SWITCH | DETECTION RESULT |
|---|---|
| 2-1 | OPEN |
| 2-2 | OPEN |
| 2-3 | CLOSE |
| 2-4 | OPEN |
| ⋮ | ⋮ |
| 2-N | OPEN |

SWITCH STATE DETECTION CIRCUIT AND SWITCH SYSTEM

CROSS-REFERENCE TO RELATED APPLICATIONS

This application is based on Japanese Patent Application No. 2013-081192 filed on Apr. 9, 2013, the contents of which are hereby incorporated by reference.

BACKGROUND OF THE INVENTION

1. Field of the Invention

The present invention relates to a switch state detection circuit that detects a state of a switch and to a switch system that has the same.

2. Description of Related Art

Conventionally, as disclosed in a patent document 1 (JP-A-2011-70309) and the like, a switch state detection circuit for detecting a state of each switch is proposed. The switch state detection circuit is used together with, for example, a control apparatus (microcomputer or the like), and inform the control apparatus of a detection result of each switch. In this way, the control apparatus can perform control in accordance with the state of each switch.

The switch state detection circuit disclosed in the patent document 1 is provided with detection portions the number of which is equal to or larger than the switches, and each detection portion detects the state of a switch corresponding to the detection portion itself. However, according to such a structure, there is a risk that the number of detection portions increases and a circuit scale of the switch state detection circuit becomes excessively large. This problem becomes more remarkable as a circuit scale of the detection portion becomes especially larger.

Besides, in a case where a plurality of detection portions are included, unevenness occurs in performance among the detection portions, and there is a risk that a suitable detection operation is hampered. Besides, in a case where the state of a switch is detected by using a constant current or the like, if the detection is simultaneously applied to many switches, there is a risk that a total consumed current becomes excessive.

SUMMARY OF THE INVENTION

In light of the above problems, it is an object of the present invention to provide a switch state detection circuit that is able to curb a circuit scale, unevenness in performance among detection portions, consumed current and the like, and to provide a switch system and a vehicle that use the switch state detection circuit.

To achieve the above object, a switch state detection according to the present invention comprises: a plurality of switch connection portions to each of which a switch is connected, a connection line to which any one of the switch connection portions is connected in a switchable manner, a detection portion that detects a state of the switch connected to the connection line based on a state of the connection line, and a connection control portion that switches successively each of the switch connection portions and connects it to the connection line, wherein the state of each switch is detected.

According to the present structure, it becomes possible to curb unevenness in performance among the detection portions, the consumed current and the like. In the meantime, as to a state of the connection line, for example, an electric current value, a voltage value or the like of the connection line is conceivable.

Besides, as the above structure, more specifically, a structure may be employed, which comprises an electric power adjustment portion that pulls up or pulls down the connection line. According to the present structure, it becomes easy to detect the state of the switch connected to the connection line based on the state of the connection line.

Besides, as the above structure, more specifically, a structure may be employed, in which a plurality of candidates for the electric power adjustment portion are prepared, and any one of the candidates for the electric power adjustment portion is set effectively. According to the present structure, it becomes possible to suitably perform the pull-up or pull-down of the connection line in accordance with, for example, a form and the like of the connected switch.

Besides, as the above structure, more specifically, a structure may be employed, in which the candidates for the electric power adjustment portion include a constant current circuit that supplies or pulls out a constant current to or from the connection line. Besides, as the above structure, more specifically, a structure may be employed, in which the constant current circuit is structured such that an electric current amount is set in an updatable manner. Besides, as the above structure, more specifically, a structure may be employed, in which the candidates for the electric power adjustment portion include a circuit that has a pull-up resistor or a pull-down resistor.

Besides, as the above structure, more specifically, a structure may be employed, which comprises a communication portion that performs communication with an external apparatus; wherein information indicating a result of the detection is transmitted to the external apparatus. Besides, as the above structure, more specifically, a structure may be employed, in which the communication portion performs the transmission in accordance with information reception from the external apparatus. Besides, as the above structure, more specifically, a structure may be employed, which comprises a storage portion that stores the result of the detection for each switch; wherein the communication portion performs the transmission when the result of the detection changes from a previous detection result.

Besides, as the above structure, more specifically, a structure may be employed, which accepts specification of any one of the switch connection portions; wherein the connection control portion switches successively each of the switch connection portions except for the specified switch connection portion and connects it to the connection line. According to the present structure, for example, it becomes possible to specify a switch connection portion not to be used and skip a wasteful operation.

Besides, as the above structure, more specifically, a structure may be employed, which is incorporated in a vehicle to detect a state of each switch that is disposed in the vehicle. Besides, a switch system according to the present invention is structured to comprise: the switch state detection circuit having the above structure; and a switch whose state is detected by the switch state detection circuit. Besides, a vehicle according to the present invention is structured to comprise: the switch state detection circuit having the above structure, and a switch whose state is detected by the switch state detection circuit.

DESCRIPTION OF THE DRAWINGS

The above object and features, other objects and features will become more apparent from the following detailed description of preferred embodiments with reference to the attached drawings.

FIG. 4 is a description view relevant to record of detection result information.

DESCRIPTION OF THE PREFERRED EMBODIMENTS

An embodiment of the present invention is described hereinafter with reference to each drawing.

[Structure and the Like of Switch State Detection Circuit]

Figure 1:
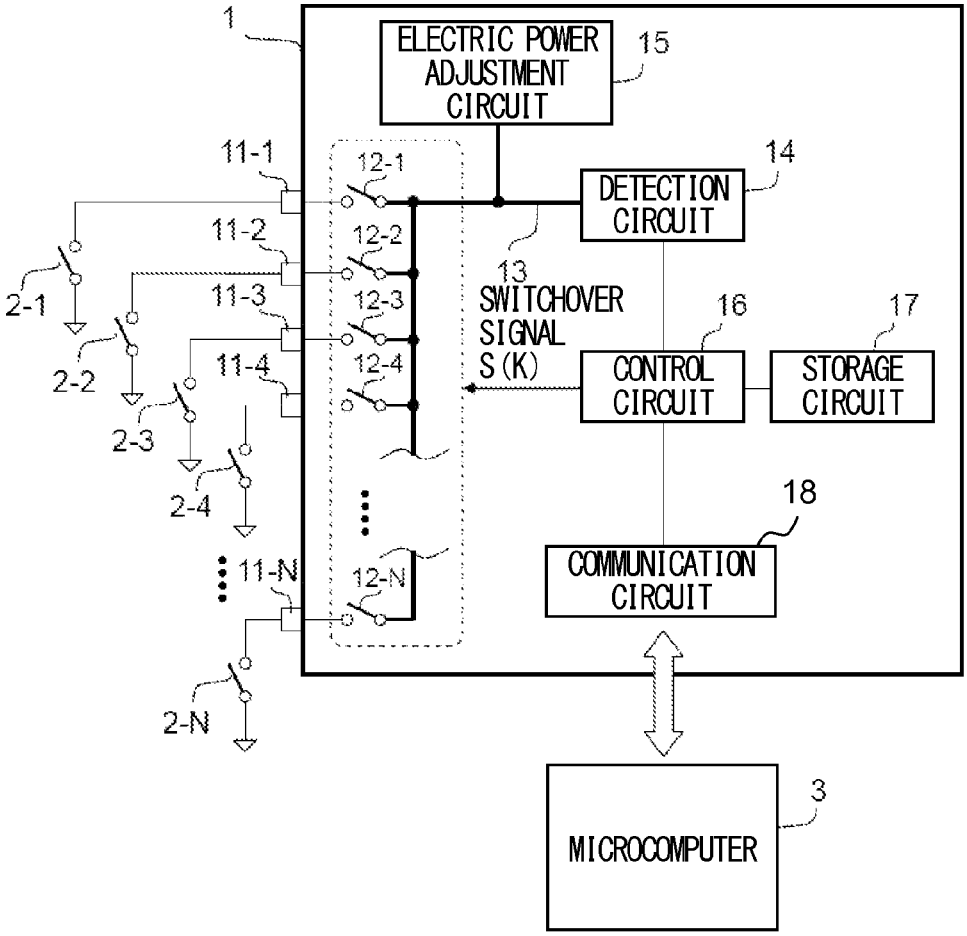
FIG. 1 is a structural view of a switch state detection circuit according to a present embodiment and a periphery around the switch state detection circuit.

FIG. 1 is a structural view of a switch state detection circuit according to the present embodiment and a periphery around the switch state detection circuit. This switch state detection circuit is used as a circuit to which a plurality of open-closed switches are connected from outside and which detects open-closed states of these open-closed switches.

As shown in FIG. 1, the switch state detection circuit 1 includes: N connection terminals (11-1 to 11-N); N switchover switches (12-1 to 12-N); a connection line 13; a detection circuit 14; an electric power adjustment circuit 15; a control circuit 16; a storage circuit 17; and a communication circuit 18. In the meantime, N is a predetermined number of 2 or larger (e.g., 48). Besides, in the following description, there are some cases where the connection terminals (11-1 to 11-N) are collectively called a "connection terminal 11" and the switchover switches (12-1 to 12-N) are collectively called a "switchover switch 12."

The connection terminal 11 is a terminal to which an open-closed switch is connected. In the present embodiment, each of the N open-closed switches (2-1 to 2-N) is connected to each of the N connection terminals (11-1 to 11-N). In other words, a K-th open-closed switch 2-K is connected to a K-th connection terminal 11-K ($1 \leq K \leq N$: the same applies hereinafter).

In the meantime, in the following description, there are some cases where the open-closed switches (2-1 to 2-N) are collectively called an "open-closed switch 2." The open-closed switch 2 is a switch which switches open-closed states between both terminals, one terminal of which is connected to the connection terminal 11, while the other terminal of which is connected to a ground point or the like.

The open-closed switch 2 conducts an electric current when in a closed state and does not conduct an electric current when in an open state. Accordingly, if an electric current is output from the connection terminal 11, the electric current flows to the ground point and the like via the open-closed switch 2 only when the open-closed switch 2 is in the closed state.

The switchover switch 12 is a switch that switches connection/disconnection between the corresponding connection terminal 11 and the connection line 13. As to the kind of the switchover switch 12, in the present embodiment, as an example, a transistor is used; however, this is not limiting. As to a K-th switchover switch 12-K, one terminal is connected to the K-th connection terminal 11-K, while the other terminal is connected to the connection line 13.

Besides, ON/OFF of the K-th switchover switch 12-K are switched in accordance with a switchover signal S (K) received from the control circuit 16. In other words, the K-th switchover switch 12-K goes to ON when the switchover signal S (K) is in an ON state (e.g., High level) and goes to OFF when the switchover signal S (K) is in an OFF state (e.g., Low level).

When the K-th switchover switch 12-K is in the ON state, the K-th switchover switch 12-K connects the K-th connection terminal 11-K to the connection line 13, and when in the OFF state, disconnects the K-th connection terminal 11-K from the connection line 13. In the meantime, as described later, each switchover signal is generated not to produce a period during which the plurality of switchover switches 12 go to ON simultaneously.

The connection line 13 is connected to each connection terminal 11 via each switchover switch 12 and to the detection circuit 14 and the electric power adjustment circuit 15. The detection circuit 14 is a circuit that detects open-closed states of the open-closed switch 12 connected to the connection line 13 based on an electric state of the connection line 13. Besides, the electric power adjustment circuit 15 is a circuit that pulls up or pulls down the connection line 13.

Figure 2:
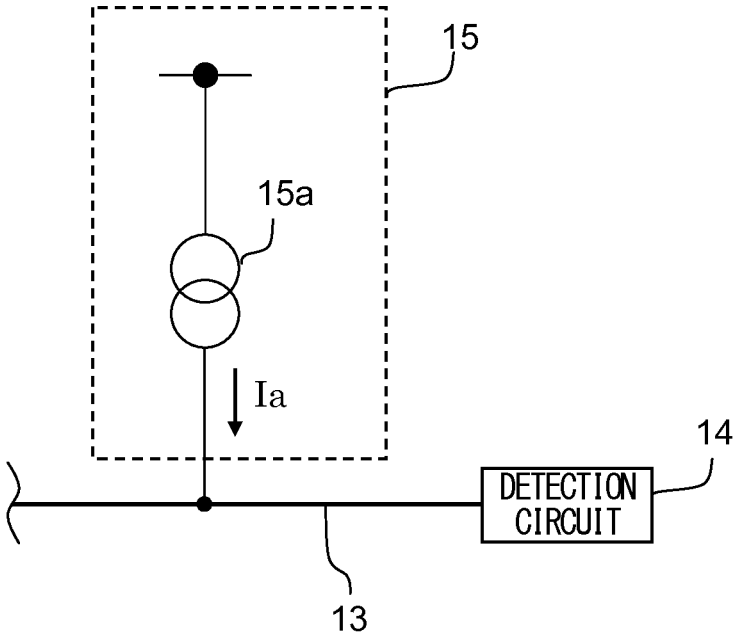
FIG. 2 is a specific structural view of an electric power adjustment circuit according to a present embodiment.

The electric power adjustment circuit 15 in the present embodiment is, as an example, composed of a constant current circuit 15*a* as shown in FIG. 2. The constant current circuit 15*a* is a circuit that supplies a constant current Ia to the connection line 13. In the meantime, the structure of the electric power adjustment circuit 15 is decided suitably in accordance with a form and the like of the open-closed switch 2 such that the open-closed states of the open-closed switch 2 are detected correctly. A modification relevant to the structure of the electric power adjustment circuit 15 is described later.

Thanks to the supply of the constant current Ia by the electric power adjustment circuit 15, the detection circuit 14 can detect correctly the open-closed states of the open-closed switch 12 connected to the connection line 13. For example, when the first open-closed switch 2-1 is connected to the connection line 13 (i.e., when the first switchover switch 12-1 is ON), the constant current Ia flows to the open-closed switch 2-1 when the open-closed switch 2-1 is in a closed state and does not flow when the open-closed switch 2-1 is in an open state.

Because of this, the electric state of the connection line 13 changes in accordance with the open-closed states of the open-closed switch 2-1. In this way, the detection circuit 14 can detect correctly the open-closed states of the open-closed switch 2-1.

The control circuit 16 controls each portion such that the switch state detection circuit 1 operates suitably. In the meantime, operation performed by the switch state detection circuit 1 is described in detail later. The storage circuit 17 stores information of a detection result by the detection circuit 14 in accordance with an instruction from the control circuit 16.

The communication circuit 18 is a circuit that perform communication with a microcomputer 3 that is an external apparatus, and performs a process to transmit information received from the control circuit 16 to the microcomputer 3 and a process to output information received from the microcomputer 3 to the control circuit 16. The communication circuit 18 may have a structure to perform serial communication with the microcomputer 3. In this case, a common communication line may be used for the transmission and reception, or different communication lines may be used for the transmission and reception.

[Operation and the Like of Switch State Detection Circuit]

Figure 3:
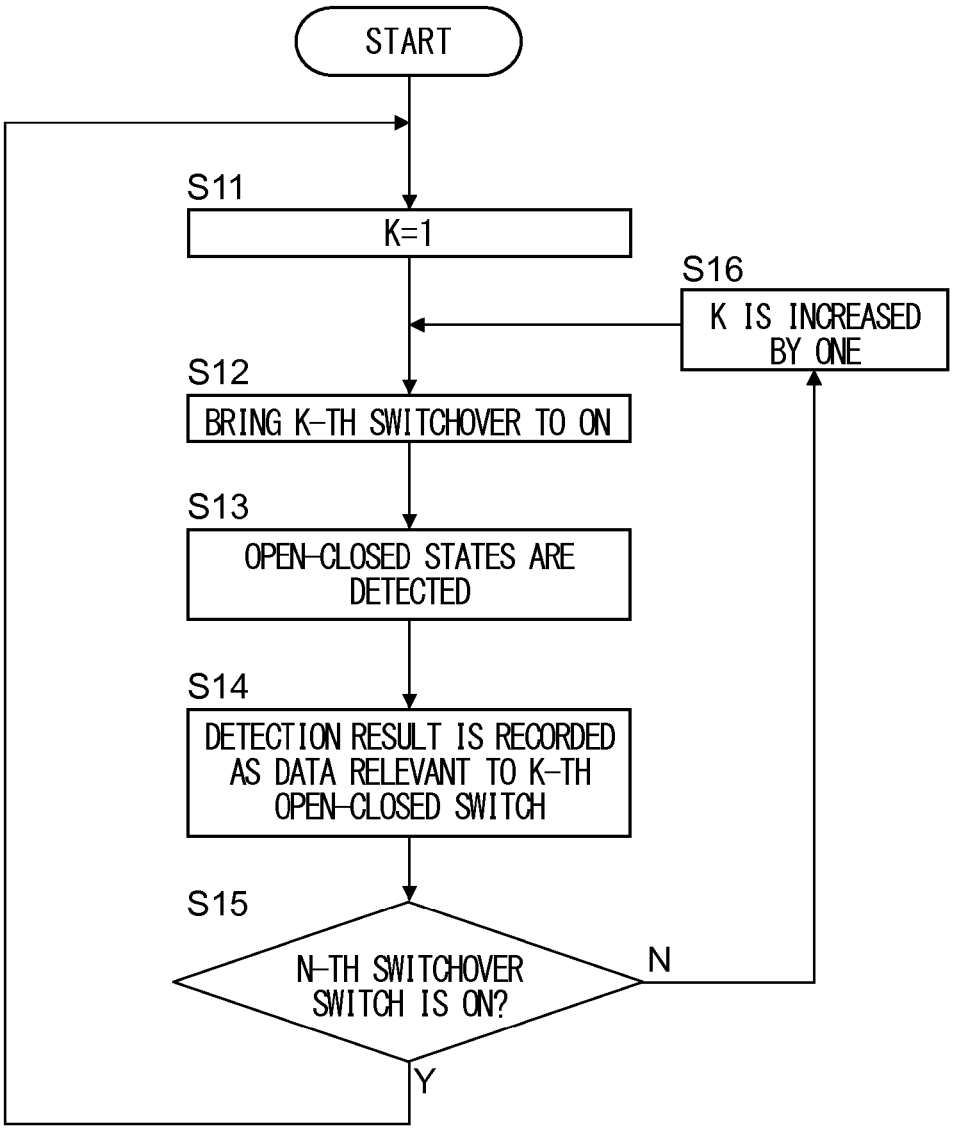
FIG. 3 is a flow chart relevant to operation for detecting and recording open-closed states.

Next, main operation performed by the switch state detection circuit 1 is described. First, operation for detecting and recording the open-closed states of each open-closed switch 2 is described hereinafter with reference to a flown chart shown in FIG. 3.

First, when K=1 (step S11), the control circuit 16 brings a switchover signal S (K) only of the switchover signals to an ON state and brings the K-th switchover switch 12-K to an ON state (step S12). In the meantime, at this time, the other switchover switches 12 are kept in an OFF state.

With the K-th switchover switch 12-K brought to the ON state, the detection circuit 14 detects open-closed states of the K-th open-closed switch 2-K (step S13). Information of this detection result is output to the control circuit 16.

And the control circuit 16 makes the storage circuit 17 record the information of the detection result received from the detection circuit 14 as data that indicates the open-closed states of the K-th open-closed switch 2-K (step S14). The detection result at this time is related to the K-th open-closed switch 2-K and recorded into the storage circuit 17.

The control circuit 16 repeats the operations of the step S12 and following steps by increasing K by one (step S16) until an N-th (i.e., the last) switchover switch 12-N is brought to an ON state (N in step S15). In this way, all the connection terminals 11 are successively switched and connected to the connection line 13, and as exemplified in FIG. 4, the information (hereinafter, called "detection result information IS") of the detection result of the open-closed states of each open-closed switch 2 is recorded.

And if the N-th switchover switch 12-N is brought to the ON state (Y in step S15), the operation performed by the control circuit 16 returns to the operation of the step S11, and the operations of the above steps S11 to S16 are repeated. As described above, each time the operations of the steps S11 to S16 are repeated, the latest detection result information is recorded into the storage circuit 17.

In the meantime, in the storage circuit 17, each time the latest detection result is recorded, the previous detection result may be overwritten (erased), or the previous detection result may also be held as history information. In the case where the previous detection result is overwritten, it becomes possible to make a storage capacity of the storage circuit as small as possible.

Figure 5:
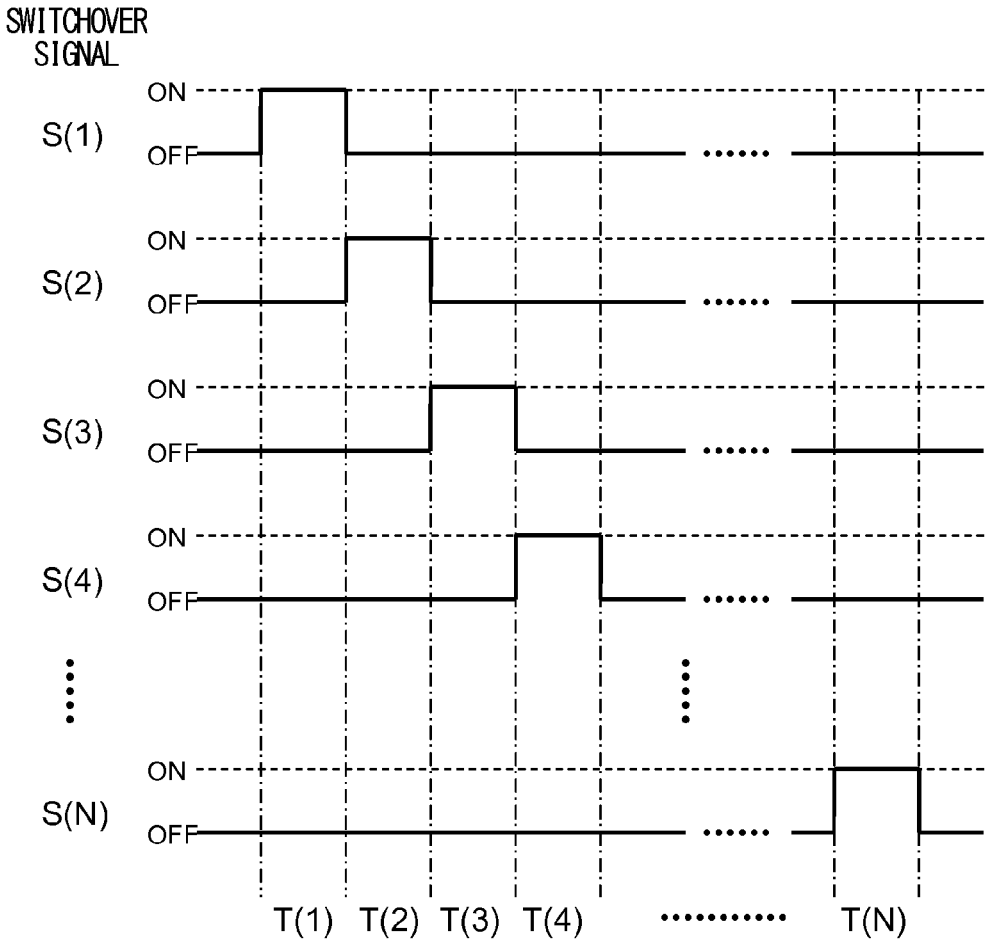
FIG. 5 is a timing chart relevant to each switchover signal.

Besides, FIG. 5 exemplifies a timing chart of each switchover signal S (1) to S (N) when the operations of the step S11 to S16 are performed. In the meantime, T (K) shown in FIG. 5 shows a period during which the K-th switchover switch 12-K is kept in the ON state. As shown in this figure, each switchover signal S (1) to S (N) is generated such that the plurality of switchover switches 12 do not go to the ON state simultaneously.

Figure 6:
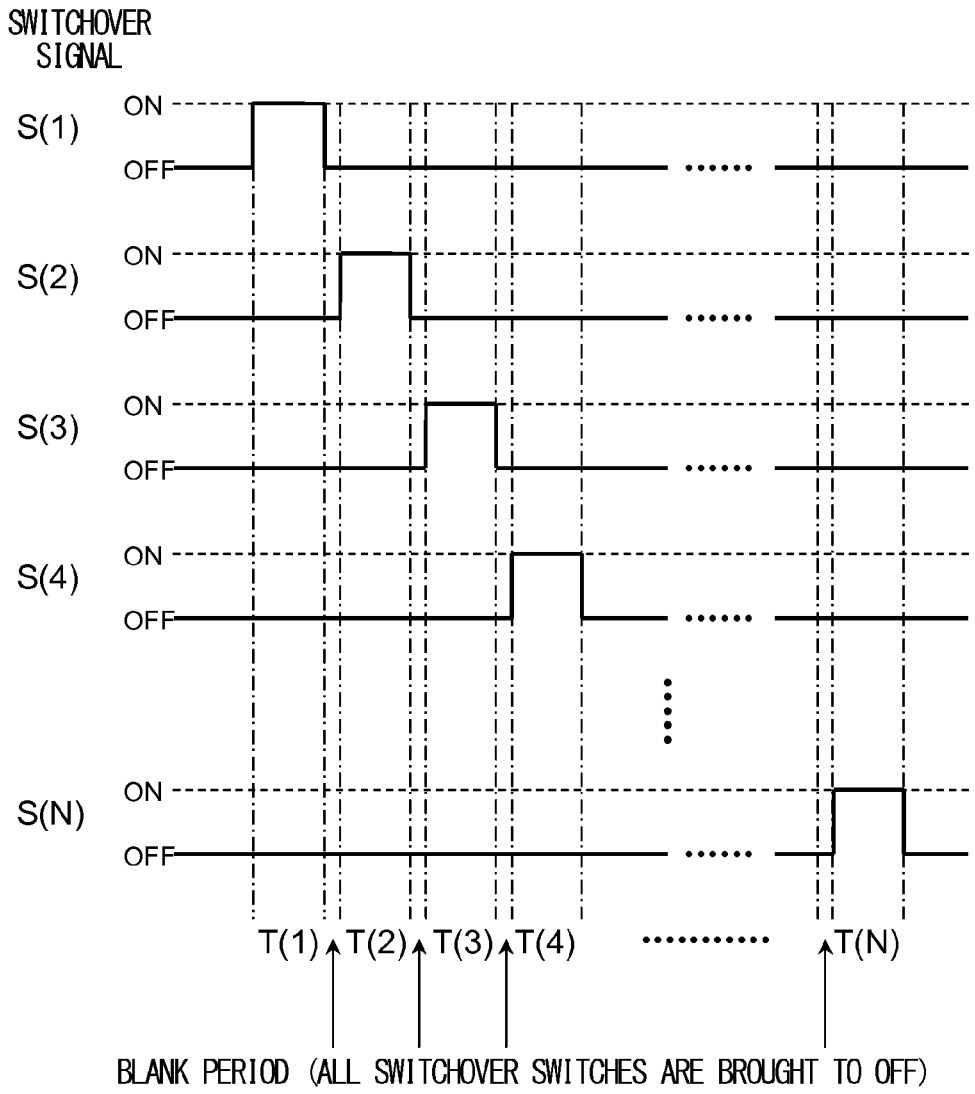
FIG. 6 is a timing chart relevant to another example of each switchover signal.

In the meantime, each switchover signal S (1) to S (N) may be generated such that a blank period (period during which all the switchover switches 12 are brought to the OFF state) occurs at a timing when the next switchover switch 12 is brought to the ON state. FIG. 6 exemplifies a timing chart of each switchover signal S (1) to S (N) in this case. In a case where such a blank period is disposed, it becomes possible to surely prevent the plurality of switchover switches 12 from going to the ON state simultaneously.

Figure 7:
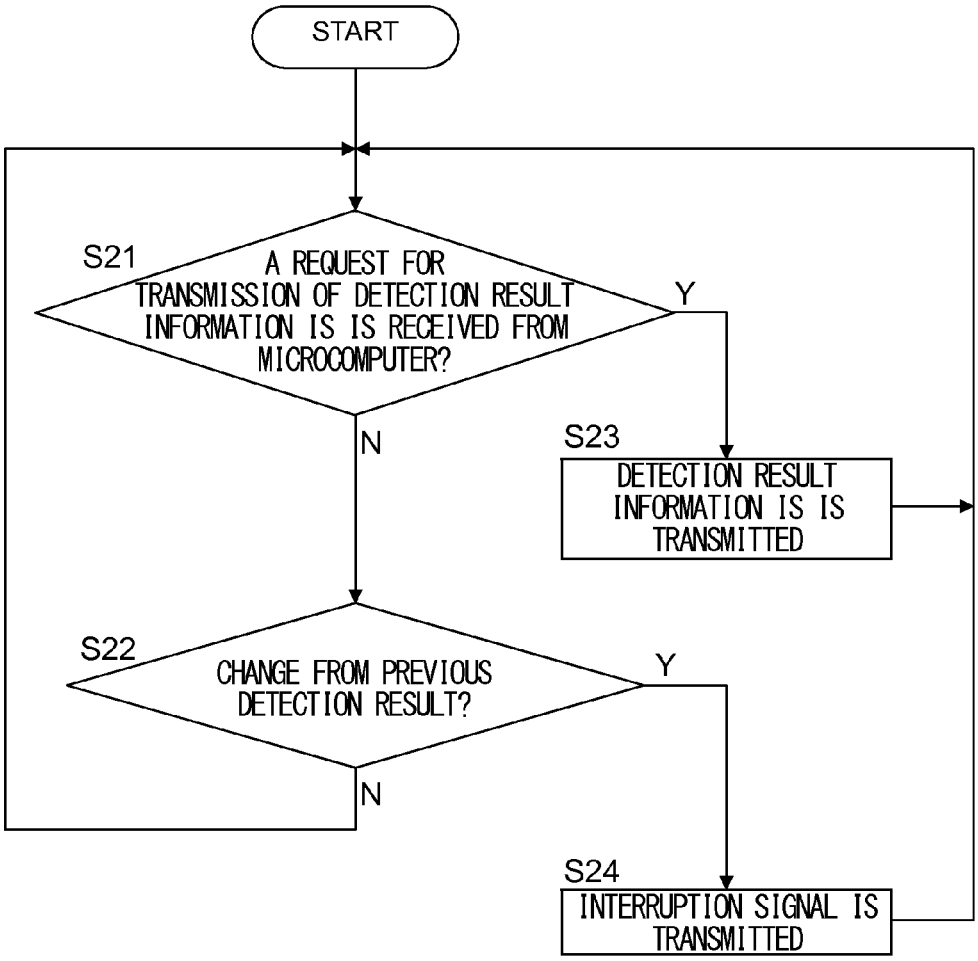
FIG. 7 is a flow chart relevant to operation for transmitting detection result information to a microcomputer.

Next, the operation for transmitting the detection result information IS to the microcomputer 3 is hereinafter described with reference to a flow chart shown in FIG. 7.

The control circuit 16 performs the above operations of the step S11 to S16 and monitors whether a request for transmitting the detection result information IS is received from the microcomputer 3 or not (step S21) and whether the latest detection result changes from the result at the time of the previous detection or not (step S22).

In a case where a request for transmitting the detection result information IS is received (reception of information from the microcomputer 3) (Y in step S21), the control circuit 16 transmits the latest detection result information IS stored in the storage circuit 17 to the microcomputer 3 (step S23). Thereafter, the operation of the control circuit 16 returns to the operation of the step S21.

In the meantime, in the case where the microcomputer 3 requests the transmission from the switch state detection circuit 1, the microcomputer 3 is in a standby state to await a response from the switch state detection circuit 1. Because of this, the control circuit 16 does not need to transmit an interruption signal and can respond to the request from the microcomputer 3 by transmitting the detection result information IS.

Besides, not only in the case of the request for the transmission of the detection result information IS but also in a case where the microcomputer 3 transmits, to the switch state detection circuit 1, information to request some response from the switch state detection circuit 1, the microcomputer 3 is in the standby state to await a response from the switch state detection circuit 1.

Because of this, also in this case, the control circuit 16 can transmit the detection result information IS to the microcomputer 3 without transmitting an interruption signal. Accordingly, even when receiving such information, the control circuit 16 may transmit the detection result information IS to the microcomputer 3.

Besides, in a case where the latest detection result changes from the result at the previous detection time (i.e., case where the detection result by the detection circuit 14 changes from the result at the previous detection time) (Y in step S22), the control circuit 16 transmits an interruption signal to the microcomputer 3 via the communication circuit 18 (step S24). Thereafter, the operation of the control circuit 16 returns to the operation of the step S21.

Usually, in a case where the open-closed states of any one of the open-closed switches 2 change, because of this change, there are many cases where some process becomes necessary. In light of such situation, the control circuit 16 is set to transmit an interruption signal to the microcomputer 3 in the case where the detection result by the detection circuit 14 changes. After receiving this interruption signal, at an arbitrary timing, for example, the microcomputer 3 can request the switch state detection circuit 1 to transmit the detection result information IS. As described above, when the transmission request is made (Y in step S2I), the control circuit 16 transmits the latest detection result information IS recorded in the storage circuit 17 to the microcomputer 3 (step S23). By receiving this detection result information IS, the microcomputer 3 can perform a suitable process in a accordance with the change in the open-closed states of the open-closed switch 2.

[Other Structures of Electric Power Adjustment Circuit]

Figure 8:
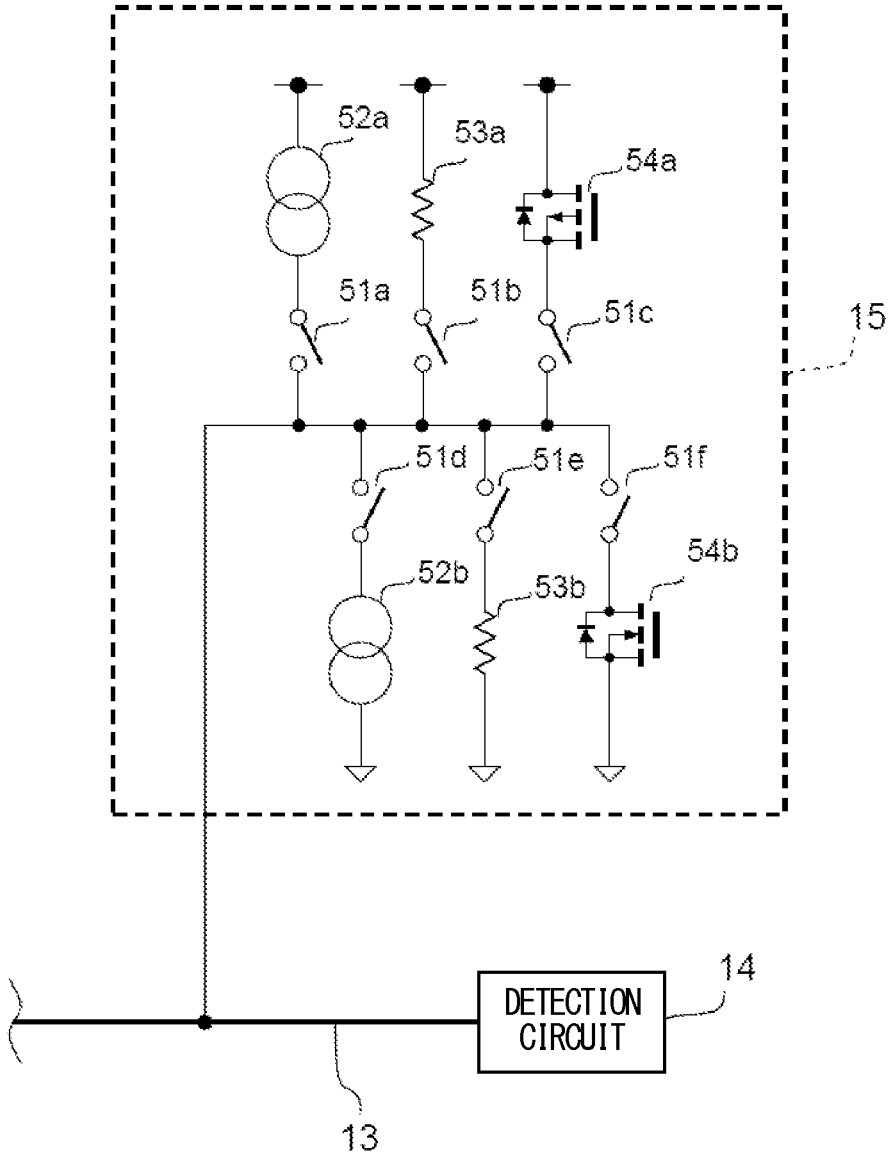
FIG. 8 is a description view relevant to another structural example of an electric power adjustment circuit.

In addition to the above structure (see FIG. 2), the electric power adjustment circuit 15 for pulling up or pulling down the connection line 13 can be structured variously in accordance with the form and the like of the open-closed switch 2. FIG. 8 shows another structural example of the electric power adjustment circuit 15.

The electric power adjustment circuit 15 shown in FIG. 8 has: setting switches (51*a* to 51*f*); constant current circuits (52*a*, 52*b*); resistors (53*a*, 53*b*); and transistors (54*a*, 54*b*).

The constant current circuit 52*a* is connected to the connection line 13 via the setting switch 51*a*. The constant current circuit 52*a* functions as a constant current circuit for pull-up that supplies a constant current to the connection line 13 when the setting switch 51*a* is in a closed state. However, when the setting switch 51*a* is in an open state, the constant current circuit 52*a* is disconnected from the connection line 13 and does not perform such a function.

The resistor 53*a* is connected to the connection line 13 via the setting switch 51*b*. The resistor 53*a* functions as a pull-up resistor that pulls up the connection line 13 when the setting switch 51*b* is in a closed state. However, when the setting switch 51*b* is in an open state, the resistor 53*a* is disconnected from the connection line 13 and does not perform such a function.

The transistor 54*a* (MOSFET in the example shown in FIG. 8) is connected to the connection line 13 via the setting switch 51*c*. The transistor 54*a* functions as a transistor (plays a roll analogous to a pull-up resistor) that pulls up the connection line 13 when the setting switch 51*c* is in a closed state. However, when the setting switch 51*c* is in an open state, the transistor 54*a* is disconnected from the connection line 13 and does not perform such a function.

The constant current circuit 52*b* is connected to the connection line 13 via the setting switch 51*d*. The constant current circuit 52*b* functions as a constant current circuit for pull-down that pulls out a constant current from the connection line 13 when the setting switch 51*d* is in a closed state. However, when the setting switch 51*d* is in an open state, the constant current circuit 52*b* is disconnected from the connection line 13 and does not perform such a function.

The resistor 53*b* is connected to the connection line 13 via the setting switch 51*e*. The resistor 53*b* functions as a pull-down resistor that pulls down the connection line 13 when the setting switch 51*e* is in a closed state. However, when the setting switch 51*e* is in an open state, the resistor 53*b* is disconnected from the connection line 13 and does not perform such a function.

The transistor 54*b* (MOSFET in the example shown in FIG. 8) is connected to the connection line 13 via the setting switch 51*f*. The transistor 54*b* functions as a transistor (plays a roll analogous to a pull-down resistor) that pulls down the connection line 13 when the setting switch 51*f* is in a closed state. However, when the setting switch 51*f* is in an open state, the transistor 54*b* is disconnected from the connection line 13 and does not perform such a function.

As to the open-closed states of each setting switch (51*a* to 51*f*), only one of the setting switches is set to the closed state such that the open-closed states of each open-closed switch 2 becomes detectable by the detection circuit 14. For example, in a case where the pull-up of the connection line 13 is necessary to detect the open-closed states of each open-closed switch 2, any one of the setting switches (51*a* to 51*c*) on the pull-up side is set to the closed state. On the other hand, in a case where the pull-down of the connection line 13 is necessary to detect the open-closed states of each open-closed switch 2, any one of the setting switches (51*d* to 51*f*) on the pull-down side is set to the closed state.

Besides, the open-closed states of each setting switch (51*a* to 51*f*) may be suitably switched in accordance with an instruction from the control circuit 16, for example, during a time when the above operations of the steps S11 to S16 are performed. In this way, even if various forms of the open-closed switches 2 mingle, it becomes possible to detect the open-closed states of each open-closed switch 2.

Figure 9:
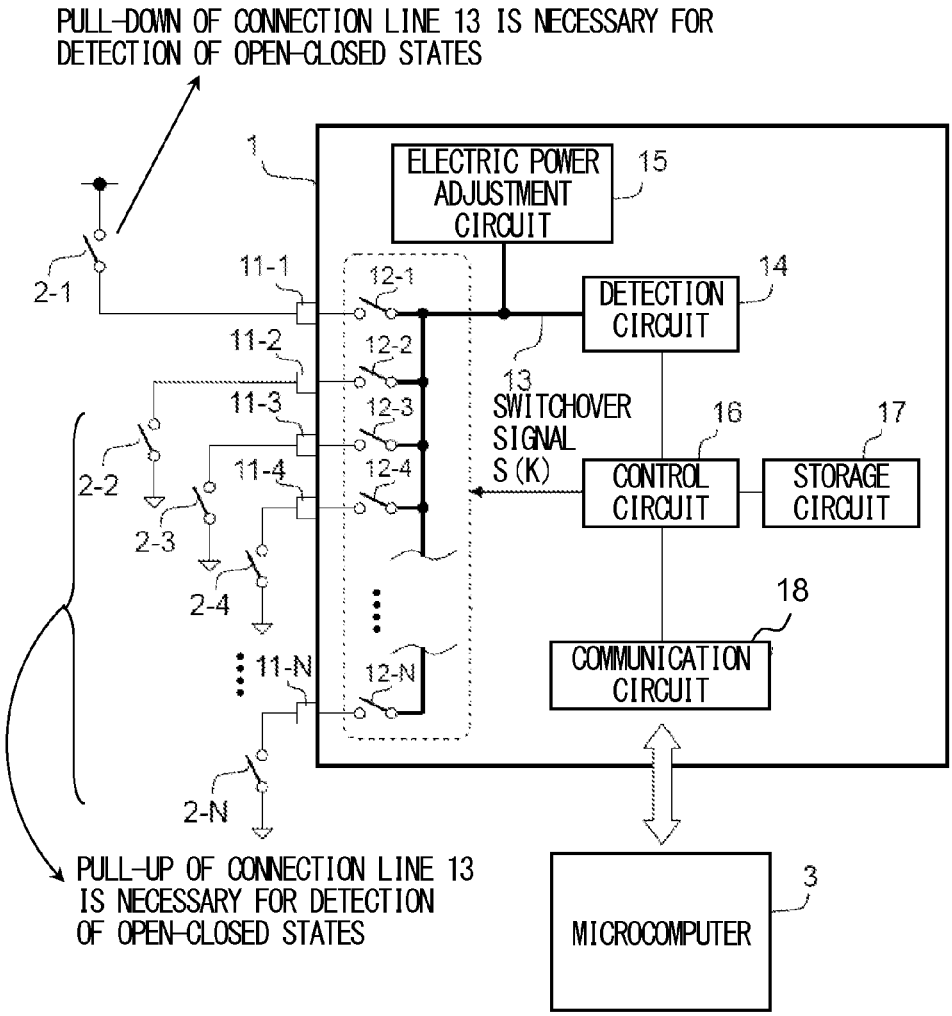
FIG. 9 is a description view relevant to a form and the like of an open-closed switch.

For example, as shown In FIG. 9, there can be a case where the open-closed switch 2-1 (open-closed switch whose one terminal is connected to a relatively high voltage source or the like) that needs to pull down the connection line 13 to detect the open-closed states and open-closed switches 2-2 to 2-N (open-closed switches whose one terminal is connected to a ground point or the like) that need to pull up the connection line 13 mingle.

In this case, the setting switches may be switched such that any one of the setting switches (51*d* to 51*f*) on the pull-down side goes to the closed state when the detection is performed as to the open-closed switch 2-1 (when the switchover switch 12-1 is brought to the ON state); and any one of the setting switches (51*a* to 51*c*) on the pull-up side goes to the closed state when the detection is performed as to the open-closed switches 2-2 to 2-N.

Besides, the constant current circuits (52*a*, 52*b*) may be designed such that an electric current amount is set in an updatable manner. In this case, it is possible to adjust the electric current amount in accordance with the form and the like of the open-closed switch 2 and to perform suitably the pull-up or pull-down of the connection line 13.

[Specification of Connection Terminal not to be Used]

The switch state detection circuit 1 has the N connection terminals 11 as already described, and it is possible to connect up to N open-closed switches 2 to the connection terminals 11. However, it is not necessary to connect the open-closed switches 2 to all of the connection terminals 11, and the switch state detection circuit 1 is usable even in a state where open-closed switches 2 the number of which is under N are connected.

In this point, the switch state detection circuit 1 may suitably accept specification (e.g., specification by a user's operation) of the connection terminal 11 not to be used. In this way, for example, in a case where there is the connection terminal 11 not to be used, the user can specify beforehand the connection terminal 11.

In a case where the specification is performed, the control circuit 16 reflects content of the specification into the operations of the steps S11 to S16. Describing more specifically, when performing the operations of the steps S11 to S16, the control circuit 16 skips each operation corresponding to the connection terminal 11 specified not to be used. In other words, the connection terminal 11 specified not to be used and the switchover switch 12 and the like corresponding to the connection terminal are handled as if they are not present.

Figure 10:
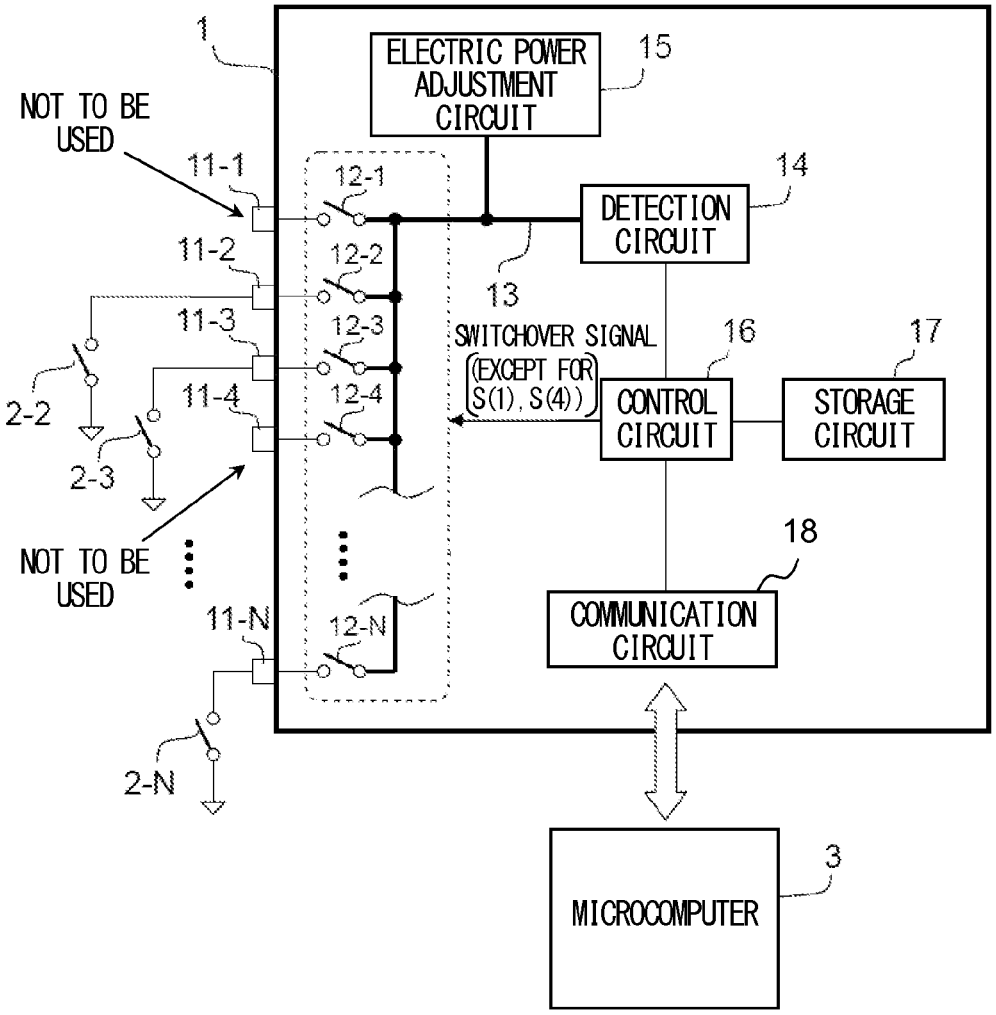
FIG. 10 is a description view relevant to specification of a connection terminal not to be used.

For example, as shown in FIG. 10, in a case where the open-closed switch 2 is not connected to the connection terminal 11-1 and the connection terminal 11-4, these terminals are specified not to be used. An in this case, the respective operations corresponding to the connection terminal 11-1 and the connection terminal 11-4 are skipped, and the switchover signal S (1) and the switchover signal S (4) are not generated.

In this way, the operations of the steps S11 to S16 are operations that switch successively each of the connection terminals 11 except for the connection terminal specified not to be used and connect them to the connection line 13. The control circuit 16 removes a wasteful operation in this way and efficiently performs the operation for detecting the open-closed states of each open-closed switch 2.

[Others]

As described above, the switch state detection circuit 1 includes: the plurality of connection terminals 11 to each of which the open-closed switch 2 is connected; the connection line 13 to which any one of the connection terminals 11 is connected in a switchable manner; and the detection circuit 14 that detects the open-closed states of the open-closed switch 2 connected to the connection line 13 based on the state of the connection line 13. Besides, the switch state detection circuit 1 includes the control circuit 14 that switches successively each of the connection terminals 11 and connect it to the connection line 13 by outputting the switchover signal to the switchover switch 12.

According to the switch state detection circuit 1 of the present embodiment, one detection circuit 14 can detect the open-closed states of each open-closed switch 2 in time division. Because of this, for example, compared with a case where detection circuits the number of which is equal to or smaller than the number of open-closed switches are disposed, it is possible to curb the circuit scale.

Besides, in a case where a plurality of detection circuits are included, there is a risk that unevenness occurs in performance among the detection circuits and a suitable detection operation is hampered. Besides, in a case where open-closed states of an open-closed switch are detected by using a constant current and the like, if the detection is simultaneously performed for many open-closed switches, there is a risk that a total consumed current becomes excessive.

However, according to the switch state detection circuit 1 of the present embodiment, one detection circuit 14 detects the open-closed states of each open-closed switch 2; accordingly, it is possible to curb the unevenness in performance among the detection circuits, the consumed current and the like. In the meantime, the switch state detection circuit of the present invention is not limited to the case where only one detection circuit is used. If the number of detection circuits is smaller than the number of switch connection portions, it becomes possible to curb the circuit scale compared with a case where the number of detection circuits is equal to or larger than the number of switch connection portions.

In the meantime, the switch state detection circuit 1 is used as one of vehicle apparatuses, for example. In this case, the switch state detection circuit 1 is incorporated in a vehicle and detects the open-closed states of each open-closed switch 2 disposed in the vehicle. And the switch state detection circuit 1 sends the detection result to the microcomputer 3 that is a control apparatus for the vehicle. In this way, the microcomputer 3 can perform control in accordance with the open-closed states of each open-closed switch 2.

Figure 11:
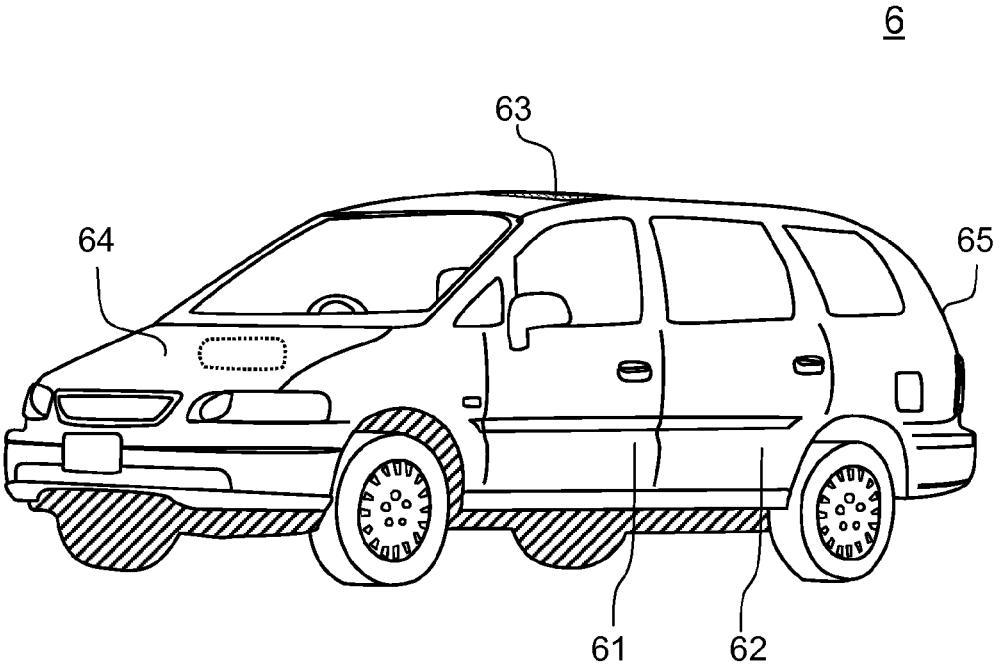
FIG. 11 is an appearance view of a vehicle according to a present embodiment.

FIG. 11 is an appearance view showing a structural example of the vehicle that incorporates the switch state detection circuit 1. The vehicle 6 has: a front door 61; a rear door 62; a sunroof 63; a bonnet 64; a trunk 65 and the like as portions corresponding to the open-closed switch 2.

The front doors 61 are disposed on sides of left and right front seats, mainly opened and closed when persons sit on and get off the front seats. The rear doors 62 are disposed on sides of left and right rear seats, mainly opened and closed when persons sit on and get off the rear seats.

The sunroof 63 is disposed on a ceiling portion of the vehicle 6, opened and closed when introducing sunshine into the vehicle 6 and blocking sunshine, for example.

The bonnet 64 is a portion in which components such as an engine and the like are stored, and is disposed in the front of the vehicle 6. The bonnet 64 is opened and closed when a component is inspected, for example.

The trunk 65 is a portion in which luggage and the like are stored, and is disposed in the rear of the vehicle 6. The trunk 65 is opened and closed when luggage is put in and out, for example.

The switch state detection circuit 1 is connected to the above portions (61 to 65) and other portions of the vehicle 6 that are opened and closed, and detects opening and closing of them. The microcomputer 3 receives information of the detection result and, for example, controls apparatuses in the vehicle 6 when each of the above portions (61 to 65) is opened such that an information lamp is turned on or an information sound is output.

Besides, the structure of the present invention is able to be modified in various ways without departing from the spirit of the invention besides the above embodiments. In other words, it should be understood that the embodiments are examples in all respects and are not limiting, and the technical scope of the present invention is not indicated by the above description of the embodiments but by the claims, and all modifications within the scope of the claims and the meaning equivalent to the claims are covered.

Besides, according to the switch state detection circuit of the present invention, it becomes possible to curb a circuit scale, unevenness in performance among detection portions, consumed current and the like. Besides, according to the switch system and vehicle of the present invention, it becomes possible to enjoy the advantages of the switch state detection circuit according to the present invention.

What is claimed is:

1. A switch state detection circuit comprising:

a plurality of switch connection portions to each of which a switch is connected, a connection line to which any one of the switch connection portions is connected in a switchable manner, a detection portion that detects a state of the switch connected to the connection line based on a state of the connection line, and a connection control portion that switches successively each of the switch connection portions and connects it to the connection line, wherein the state of each switch is detected.

2. The switch state detection circuit according to claim 1, comprising an electric power adjustment portion that pulls up or pulls down the connection line.

3. The switch state detection circuit according to claim 2, wherein a plurality of candidates for the electric power adjustment portion are prepared, and any one of the candidates for the electric power adjustment portion is set effectively.

4. The switch state detection circuit according to claim 3, wherein the candidates for the electric power adjustment portion include a constant current circuit that supplies or pulls out a constant current to or from the connection line.

5. The switch state detection circuit according to claim 4, wherein the constant current circuit is structured such that an electric current amount is set in an updatable manner.

6. The switch state detection circuit according to claim 3, wherein the candidates for the electric power adjustment portion include a circuit that has a pull-up resistor or a pull-down resistor.

7. The switch state detection circuit according to claim 1, comprising a communication portion that performs communication with an external apparatus, wherein information indicating a result of the detection is transmitted to the external apparatus.

8. The switch state detection circuit according to claim 7, wherein the communication portion performs the transmission in accordance with information reception from the external apparatus.

9. The switch state detection circuit according to claim 7, comprising a storage portion that stores the result of the detection for each switch, wherein the communication portion performs the transmission when the result of the detection changes from a previous detection result.

10. The switch state detection circuit according to claim 1, wherein the switch state detection circuit accepts specification of any one of the switch connection portions, wherein the connection control portion switches successively each of the switch connection portions except for the specified switch connection portion and connects it to the connection line.

11. The switch state detection circuit according to claim 1, wherein the switch state detection circuit is incorporated in a vehicle to detect a state of each switch that is disposed in the vehicle.

12. A switch system comprising:

the switch state detection circuit according to claim 1, and a switch whose state is detected by the switch state detection circuit.

13. A vehicle comprising:

the switch state detection circuit according to claim 11, and a switch whose state is detected by the switch state detection circuit.

* * * * *